US009441407B2

(12) United States Patent
Zetti

(10) Patent No.: US 9,441,407 B2
(45) Date of Patent: Sep. 13, 2016

(54) SNAP HINGE WITH DAMPED CLOSING

(71) Applicant: D.G.N. S.R.L., Modena (IT)

(72) Inventor: Daniele Zetti, Modena (IT)

(73) Assignee: D.G.N. S.R.L., Modena (IT)

( * ) Notice: Subject to any disclaimer, the term of this patent is extended or adjusted under 35 U.S.C. 154(b) by 0 days.

(21) Appl. No.: 14/436,021

(22) PCT Filed: Oct. 15, 2012

(86) PCT No.: PCT/IT2012/000316

§ 371 (c)(1),
(2) Date: Apr. 15, 2015

(87) PCT Pub. No.: WO2014/061041

PCT Pub. Date: Apr. 24, 2014

(65) Prior Publication Data

US 2015/0267452 A1 Sep. 24, 2015

(51) Int. Cl.
*E05F 1/08* (2006.01)
*E05D 3/06* (2006.01)
(Continued)

(52) U.S. Cl.
CPC . *E05F 3/20* (2013.01); *E05D 3/06* (2013.01); *E05D 3/16* (2013.01); *E05F 3/18* (2013.01);
(Continued)

(58) Field of Classification Search
CPC ..... Y10T 16/2771; Y10T 16/304; Y10T 16/5383; Y10T 16/53832; Y10T 16/53833; Y10T 16/53843; Y10T 16/547; Y10T 16/5476; Y10T 16/299; E05D 3/06; E05D 3/16; E05D 3/14; E05D 11/1021; E05D 2003/163; E05D 2003/166; E05F 1/14; E05F 3/18; E05F 3/20; E05F 5/02; E05F 5/006; E05Y 2201/21; E05Y 2201/212; E05Y 2201/264; E05Y 2201/412; E05Y 2201/424; E05Y 2201/428; E05Y 2201/496; E05Y 2201/254; E05Y 2800/21; E05Y 2900/20; E05Y 2900/512; E05Y 2900/538
See application file for complete search history.

(56) References Cited

U.S. PATENT DOCUMENTS 2,120,685 A * 6/1938 Soss ..... E05D 3/16 16/288
3,363,281 A * 1/1968 Borsani ..... E05D 3/16 16/288

(Continued)

FOREIGN PATENT DOCUMENTS

DE 202005016375 U1 12/2005
DE 202007004621 U1 8/2008

(Continued)

OTHER PUBLICATIONS

International Search Report and Written Opinion for corresponding application PCT/IT2012/000316; dated Jun 7, 2013; 12 pages.

*Primary Examiner* — Chuck Mah
(74) *Attorney, Agent, or Firm* — Brooks Kushman P.C.

(57) ABSTRACT

A snap hinge with damped closure is provided, including a first articulated quadrilateral and a second articulated quadrilateral which share a first lever and a second lever and are provided respectively with a plate for coupling to a first element and with a plate for fixing to a second element. The hinge is movable alternately between an open configuration and a closed configuration, in which the plates have different arrangements with respect to each other. At least one damping element is interposed at least between the first quadrilateral and the coupling plate or between the second quadrilateral and the fixing plate for damped transition from the open configuration to the closed configuration or vice versa.

17 Claims, 5 Drawing Sheets

(51) Int. Cl.

| | |
|---|---|
| ***E05F 3/20*** | (2006.01) |
| ***E05D 3/16*** | (2006.01) |
| ***E05F 5/02*** | (2006.01) |
| ***E05F 3/18*** | (2006.01) |
| *E05F 1/14* | (2006.01) |

(52) U.S. Cl.

CPC ..... *E05F 5/02* (2013.01); *E05D 2003/166* (2013.01); *E05F 1/14* (2013.01); *E05Y 2201/21* (2013.01); *E05Y 2201/264* (2013.01); *E05Y 2201/412* (2013.01); *E05Y 2201/424* (2013.01); *E05Y 2201/488* (2013.01); *E05Y 2201/496* (2013.01); *E05Y 2800/21* (2013.01); *E05Y 2900/20* (2013.01); *E05Y 2900/512* (2013.01); *E05Y 2900/538* (2013.01); *Y10T 16/299* (2015.01); *Y10T 16/304* (2015.01)

(56) References Cited

U.S. PATENT DOCUMENTS

| | | | | |
|---|---|---|---|---|
| 5,035,026 | A * | 7/1991 | Carlo | E05D 3/16 16/288 |
| 5,058,238 | A * | 10/1991 | Lautenschlager | E05D 3/16 16/278 |
| 5,103,532 | A * | 4/1992 | Youngdale | E05D 3/16 16/288 |
| 6,374,459 | B1 * | 4/2002 | Zetti | E05D 3/16 16/286 |
| 7,197,790 | B1 * | 4/2007 | Edmondson | E05D 3/16 16/286 |
| 7,406,749 | B2 * | 8/2008 | Herper | E05F 5/006 16/286 |
| 7,574,775 | B2 | 8/2009 | Zetti | |
| 8,225,459 | B2 | 7/2012 | Waltemate et al. | |
| 2001/0025398 | A1 * | 10/2001 | Zetti | E05D 3/16 16/370 |
| 2003/0159249 | A1 * | 8/2003 | Tsung-Lung | E05D 3/16 16/371 |
| 2004/0177476 | A1 * | 9/2004 | Zetti | E05D 3/16 16/287 |
| 2004/0181903 | A1 | 9/2004 | Salice | |
| 2005/0155180 | A1 * | 7/2005 | Lin | E05D 11/1021 16/287 |
| 2005/0188505 | A1 * | 9/2005 | Bennett | E05D 3/16 16/366 |
| 2006/0156513 | A1 * | 7/2006 | Zetti | E05D 3/16 16/288 |
| 2006/0282983 | A1 * | 12/2006 | Zetti | E05D 3/16 16/287 |
| 2007/0006420 | A1 * | 1/2007 | Zetti | E05D 3/16 16/287 |
| 2008/0141490 | A1 * | 6/2008 | Lautenschlager | E05F 5/006 16/235 |
| 2008/0276425 | A1 * | 11/2008 | Gherardi | A47L 15/4261 16/319 |
| 2009/0133218 | A1 * | 5/2009 | Spreafico | E05D 3/16 16/304 |
| 2010/0101052 | A1 * | 4/2010 | Waltemate | E05D 3/16 16/297 |
| 2010/0269293 | A1 * | 10/2010 | Wisniewski | E05D 3/14 16/250 |
| 2011/0072617 | A1 * | 3/2011 | Lin | E05F 5/006 16/298 |
| 2013/0152339 | A1 * | 6/2013 | Hung | E05D 3/16 16/50 |

FOREIGN PATENT DOCUMENTS

| | | | |
|---|---|---|---|
| DE | 102008035926 | A1 | 2/2010 |
| EP | 1460219 | A2 | 9/2004 |
| EP | 1609936 | A2 | 12/2005 |
| EP | 1653029 | A2 | 5/2006 |
| EP | 1741860 | A1 | 1/2007 |
| WO | 2012168951 | A1 | 12/2012 |

* cited by examiner

SNAP HINGE WITH DAMPED CLOSING

CROSS-REFERENCE TO RELATED APPLICATION

This application is the U.S. national phase of PCT Application No. PCT/IT2012/000316 filed on Oct. 15, 2012, the disclosure of which is incorporated in its entirety by reference herein.

TECHNICAL FIELD

The present invention relates to a snap hinge with damped closing.

BACKGROUND

In the field of furniture, it is known to use snap hinges adapted for the rotation of a closure element about a hinge axis, such as for example snap hinges used to open and close doors on cabinets arranged inside caravans or the like. These snap hinges with two articulated quadrilaterals are provided with appropriately arranged elastic means, such as for example snap hinges described in patents EP 1741860 and EP 1653029, in order to keep the door in the stable closed equilibrium position so as to prevent its accidental opening, for example, when the caravan or the like is moving or on a curve, avoiding the consequent escape of the content from the cabinet.

In the final steps of opening and closing, the elastic means tend to push the door toward the stable equilibrium position and, especially during closure, rapidly contract the snap hinges into the closure position, suddenly drawing back the door, which, if not restrained with one's hand, strikes the cabinet violently.

For obviating this drawback, damping devices are known which are adapted to slow the closure of the door onto the cabinet so as to prevent the final step of the closure of said door from occurring violently. In particular, said damping devices comprise a tube damper the two ends of which, connected respectively to the door and to the cabinet, can move alternately toward or away from each other more slowly, thus avoiding the collision of the two elements during closure.

These known types of damping devices are not free from drawbacks, which include the fact that they limit laterally the access to the content of the cabinet. To ensure an optimum opening angle of the door, the first end of the tube damper is in fact connected to the internal side wall of the cabinet and the second end is connected to the internal surface of the door. During opening, the tube damper, in the fully extended condition, restricts with its bulk the access to the internal part of the cabinet, a limitation which is not negligible in confined spaces such as for example in caravans or the like.

This drawback is partly obviated by a damping device that can be installed exclusively on the internal surface of the cabinet, as described for example in PCT/IT2011/000187 in the name of the same inventor of the present application and in patent applications EP1460219 and EP1609936. In particular, these devices comprise a main body that can be installed on the internal surface of the cabinet from which a piston protrudes which is damped by compression and is designed to make contact, with one of its free ends, with the internal surface of the door during closure. In particular, during the final closure step the piston is compressed by the door, passing from an extended position to a compressed position more slowly, restraining the closing door and avoiding a violent collision.

However, even these devices of the known type, with their bulk, restrict front access to the content of the cabinet. Their placement inside the cabinet, so as to make contact with the closing door, in fact is a hindrance for the insertion and extraction of objects inside said cabinet. This drawback can be observed to a greater extent in the presence of small cabinets, such as for example in caravans or the like, in which all the useful space available is utilized in the best possible way, and in which access, which is already limited due to the dimensions of said cabinet, might not be feasible due to the presence of the damping devices.

Another drawback of these devices of the known type resides in that they require an additional step of installation, increasing considerably the final production costs. The normal steps of installation of doors on cabinets are in fact by now completely automated and the insertion of an additional step of installation of the damping device requires the addition of an expensive manual step of installation or insertion of a new automatic step, requiring expensive modifications to the automation currently in use.

SUMMARY

The aim of the present invention is to provide a snap hinge with damped closure that obviates the drawbacks and overcomes the limitations of the background art, allowing the damped closure of a closure element with respect to a structure of a piece of furniture or the like without limiting in any way access to the interior of said piece of furniture.

Within this aim, an object of the present invention is to provide a hinge that can be installed easily on the closure element and on the respective piece of furniture without requiring any additional step of work, containing production costs.

A further object of the invention is to provide a hinge that is capable of giving the greatest assurances of reliability and safety of use.

Another object of the invention is to provide a hinge that is easy to provide and economically competitive if compared to the background art.

This aim, these objects and others that will become more apparent hereinafter are achieved by a snap hinge with damped closure, comprising a first articulated quadrilateral and a second articulated quadrilateral which share a first lever and a second lever and are provided respectively with a plate for coupling to a first element and with a plate for fixing to a second element, said hinge being movable alternately between an open configuration and a closed configuration, wherein said plates have different arrangements with respect to each other, characterized in that it comprises at least one damping element that is interposed at least between said first quadrilateral and said coupling plate or between said second quadrilateral and said fixing plate for damped transition from said open configuration to said closed configuration or vice versa.

BRIEF DESCRIPTION OF THE DRAWINGS

Further characteristics and advantages will become more apparent from the description of a preferred but not exclusive embodiment of a snap hinge with damped closure, illustrated by way of non-limiting example with the aid of the accompanying drawings, wherein.

DETAILED DESCRIPTION

Figure 1:
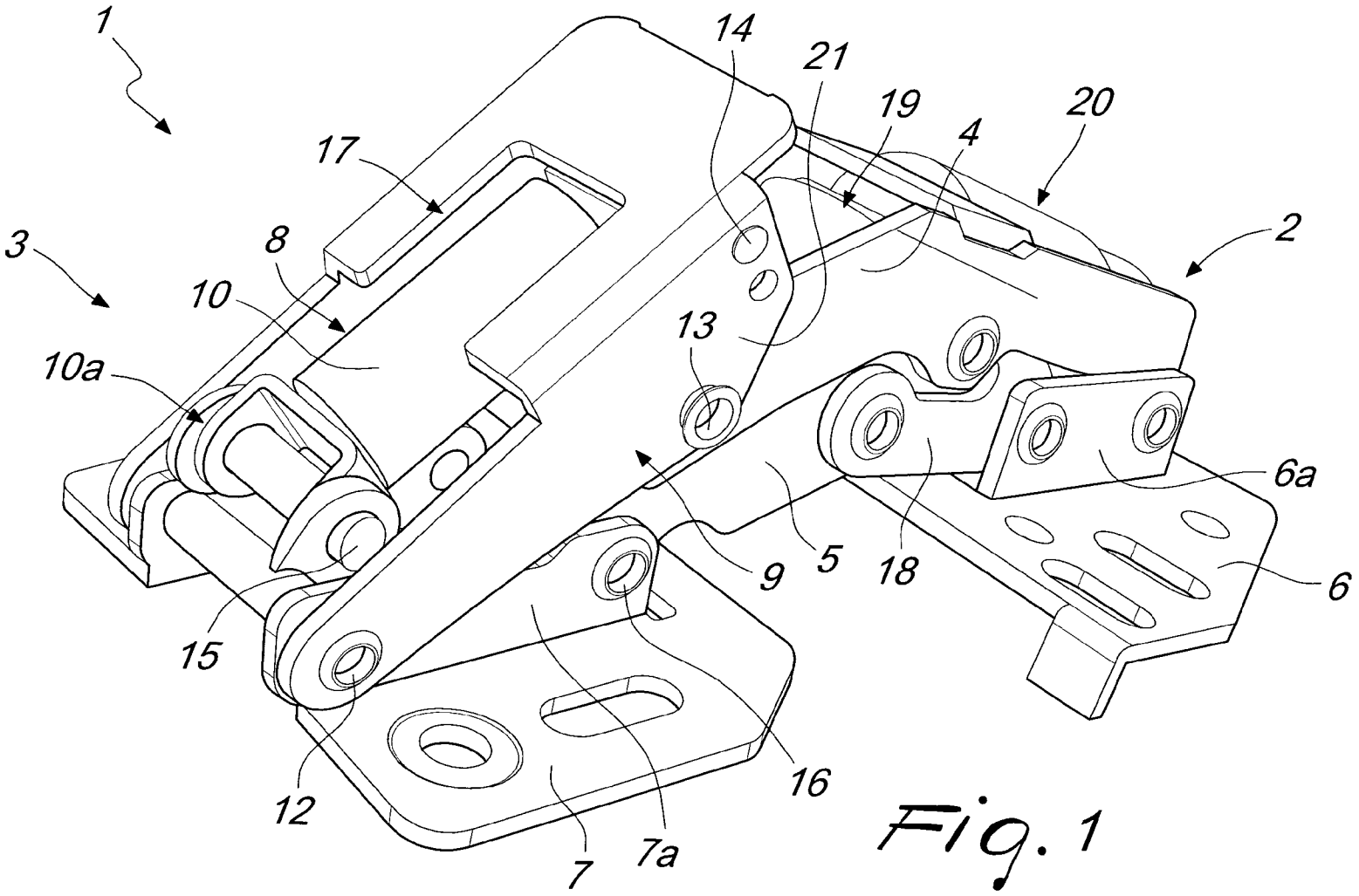
FIG. 1 is a schematic perspective view of a snap hinge with damped closure, according to the invention.

With reference to the cited figures, the snap hinge with damped closure, generally designated by the reference numeral 1, comprises a first articulated quadrilateral 2 and a second articulated quadrilateral 3, which share a first lever 4 and a second lever 5 and are provided respectively with a plate 6 for coupling to a first element 101 and with a plate 7 for fixing to a second element 102. Said hinge 1 can move alternately between an open configuration and a closed configuration, in which the plates 6 and 7 have mutually different arrangements.

According to the invention, the hinge 1 comprises at least one damping element 8, which is interposed between at least the first quadrilateral 2 and the coupling plate 6 or between the second quadrilateral 3 and the fixing plate 7 for the damped transition from said open configuration to said closed configuration or vice versa.

In particular, the damping element 8 is interposed between the second quadrilateral 3 and the fixing plate 7 for damped transition from the open configuration to the closed configuration. Alternatively, the damping element can be interposed between the first quadrilateral 2 and the coupling plate 6 again for damped transition from the open configuration to the closed configuration of the hinge 1.

Conveniently, the first quadrilateral 2 comprises a second arm 18 which is articulated to the coupling plate 6 and to an end of the second lever 5, whereas the second quadrilateral 3 comprises a first arm 9 which is articulated to the fixing plate 7 and to an end of the first lever 4. The damping element 8 is interposed between the first arm 9 and the fixing plate 7.

In turn, the damping element 8 comprises a cylindrical main body 10 in which a stem 11 can slide axially. The main body 10 has a first end 10*a* which is associated so that it can rotate with the fixing plate 7 and the stem 11 is provided with a second end 11*a* that can move with respect to the first end 10*a* and is associated so that it can rotate with the first arm 9. The position of the stem 11 with respect to the body 10 defines various positions of the damping element 8, which in particular can move between a compression position, in which the ends 10*a* and 11*a* are mutually closer and the hinge 1 is in the open configuration, and an extended position, in which the ends 10*a* and 11*a* are mutually spaced and said hinge 1 is in the closed configuration. The damping element 8 comprises braking means of a known type, such as for example one-way valves, not shown in the accompanying figures, for slowed transition from the compression position to the extension position.

Conveniently, the first arm 9 comprises a first fulcrum 14, in which the second end 11*a* is pivoted. In addition to this, the first arm 9 has a first pivot 12 that is hinged to the fixing plate 7 and a second pivot 13 that is hinged to an end of the first lever 4. The first pivot 12 and the second pivot 13 delimit a side 3*a* of the second quadrilateral 3, delimiting externally the position of the first fulcrum 14.

Figure 2:
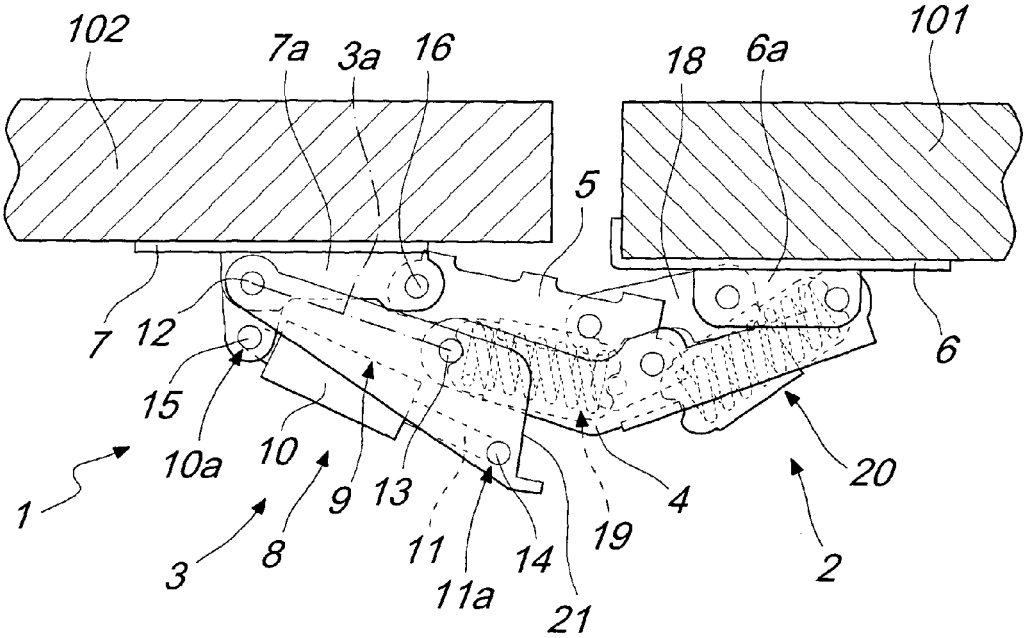
FIG. 2 is a schematic lateral elevation view of the hinge of FIG. 1 in the open configuration.
Figure 5:
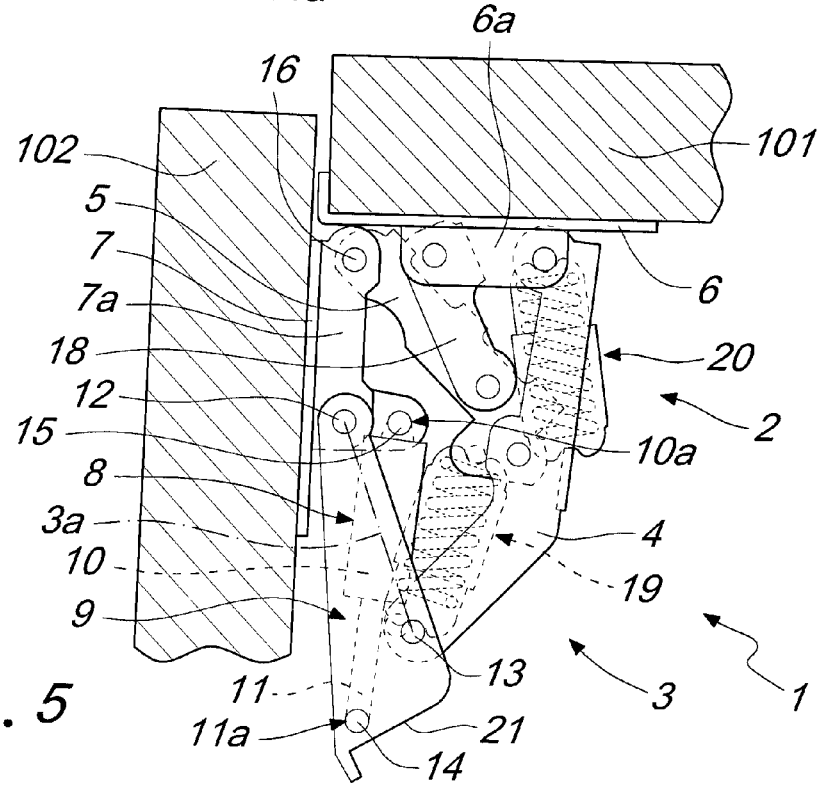
FIG. 5 is a schematic lateral elevation view of the hinge of FIG. 1 in the closed configuration.
Figure 6:
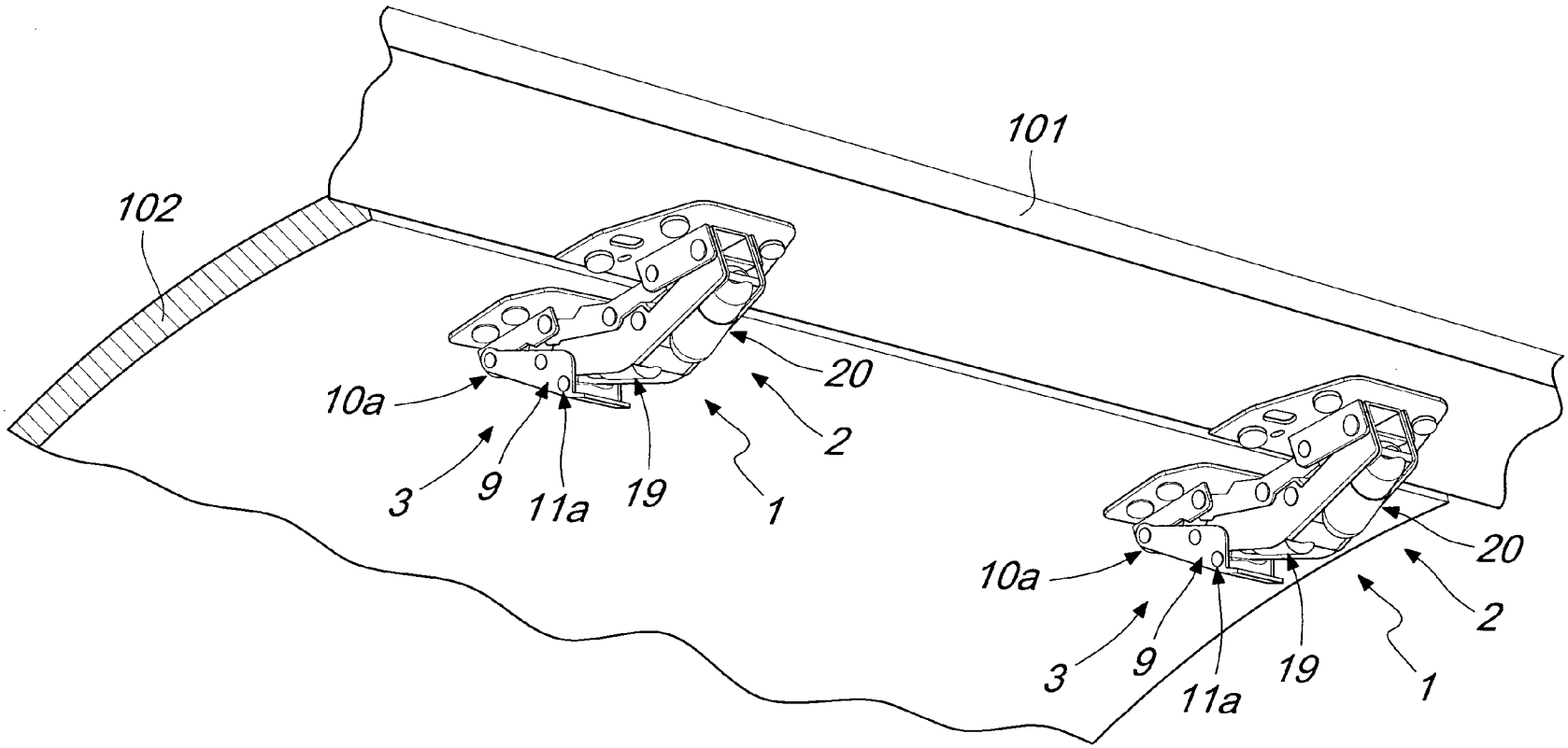
FIG. 6 is a schematic perspective view of two hinges applied to two respective elements which are mutually open.

The fixing plate 7 comprises a second fulcrum 15, which is pivoted to the first end 10*a*. Conveniently, the fixing plate 7 shares the first pivot 12 with the first arm 9 and a third pivot 16 which is hinged to one end of the second lever 5. The second fulcrum 15 is arranged so that it can be spaced further from the fixing plate 7 than the first pivot 12 so as to be positioned within the second quadrilateral 3 when the hinge 1 is in the closed configuration, as shown in FIG. 5, and outside said second quadrilateral when the hinge 1 is in the open configuration, as shown in FIG. 2. In particular, the second fulcrum 15 is arranged substantially on a plane that passes through the first pivot 12 and is perpendicular to the plane of arrangement of the fixing plate 7.

The first arm 9, formed by a suitably shaped plate, has in its central portion a passage opening 17 for the movement of the damping element 8 during transition from the extension position to the compression position.

Finally, the hinge 1 comprises at least first elastic means 19, which are interposed between the first lever 4 and the second lever 5 for its stable arrangement in the closed and open configurations. Furthermore, in order to increase stability in the configurations mentioned above, the hinge 1 comprises at least second elastic means 20 which are interposed between the first lever 4 and the coupling plate 6.

In a first embodiment, shown in FIGS. 1 to 6, the first arm 9 is formed by a suitably shaped plate, on the central portion of which there is the passage window 17 and laterally, on two wings 21 that are perpendicular to the central portion and substantially triangular, there are adapted slots for the passage of the first pivot 12, of the second pivot 13 and of the first fulcrum 14. The plates 6 and 7 are arranged along substantially parallel planes when the hinge 1 is in the open configuration, as shown in FIG. 2, allowing access to the interior of the cabinet. In particular, the first element 101 is the upper portion of the cabinet and the door is the element 102. In the closed configuration, as shown in FIG. 5, the plates 6 and 7 are arranged along substantially mutually perpendicular planes, arranging the door so that it closes on to the cabinet. Both the coupling plate 6 and the fixing plate 7 have respective pairs of protrusions 6*a* and 7*a* that extend at right angles to said plates. On each pair of protrusions 6*a* and 7*a* there are four passage slots, which are substantially equidistant from the respective plate, for the accommodation of the different pivots of the first quadrilateral 2 and of the second quadrilateral 3.

Conveniently, the elastic means 19 and 20 are springs of the helical type supported by guiding elements that comprise telescopic capsules. In other embodiments, the possibility of using different elastic means, optionally supported by adapted guiding elements, is not excluded.

Figure 7:
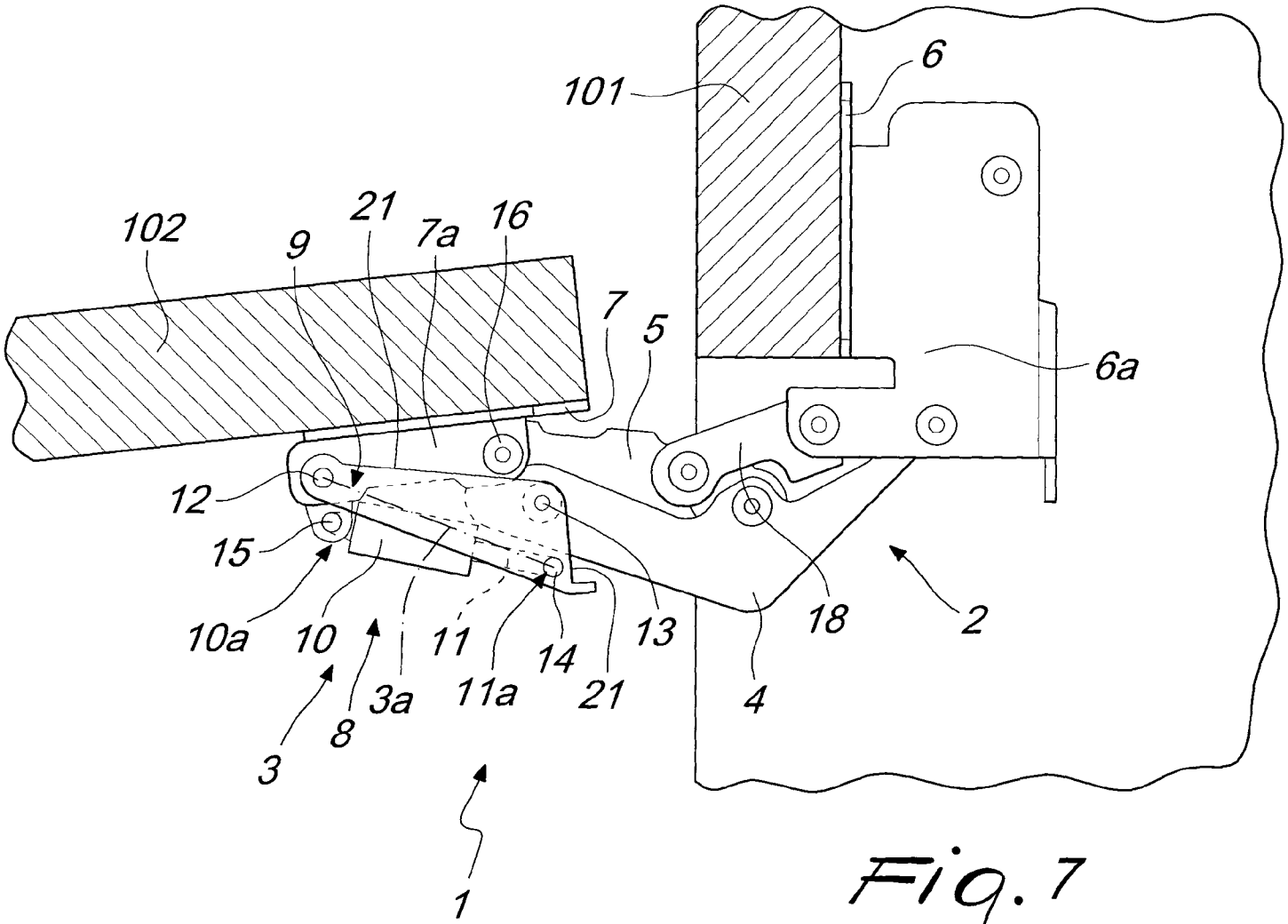
FIG. 7 is a schematic lateral elevation view of a variation of the hinge of FIG. 1.

In a variation of the hinge 1, shown in FIG. 7, the coupling plate 6 has a different shape, having its own installation surface intended to be installed on the internal surface of the element 101 substantially at right angles to the plane on which the hinge axes, which pass through the four slots in which the second arm 18 and the first lever 4 are pivoted, are arranged. This configuration allows the mutual placement of the two plates 6 and 7 along mutually perpendicular planes with the hinge in the open configuration, as shown in FIG. 7, whereas said plates are arranged along mutually parallel planes with the hinge in the closed configuration.

In other embodiments, not shown in the accompanying figures, the plates 6 and 7 can have different shapes, so that they can be installed on different cabinets or doors that have complex shapes or are arranged on mutually transverse planes.

The operation of the snap hinge 1 with damped closure is described hereinafter.

Initially, the hinge 1 is in the stable open configuration, shown in FIG. 2. By applying conveniently such a force as to overcome the contrast force of the elastic means 19 and 20 on the element 102 for its approach to the element 101, such as for example a downward force for the rotation of the door about a horizontal hinge axis for closure onto the respective cabinet, the hinge 1 passes progressively toward the closed configuration.

Figure 3:
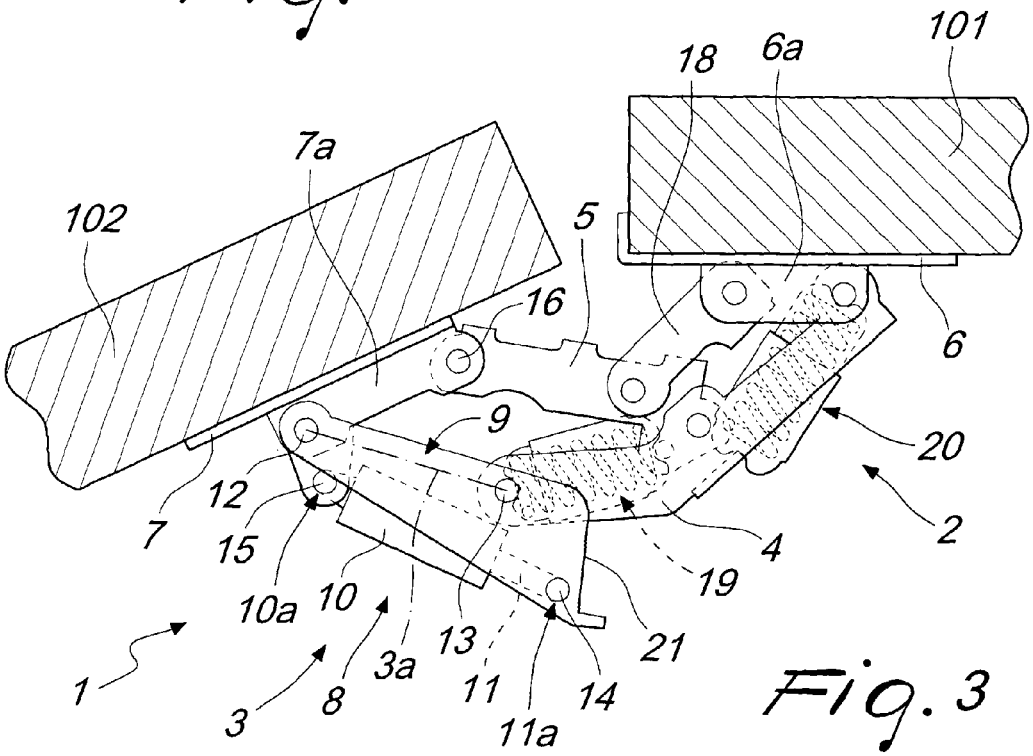
FIGS. 3 and 4 are schematic lateral elevation views of the hinge of FIG. 1 in successive intermediate steps between an open configuration and a closed configuration.
Figure 4:
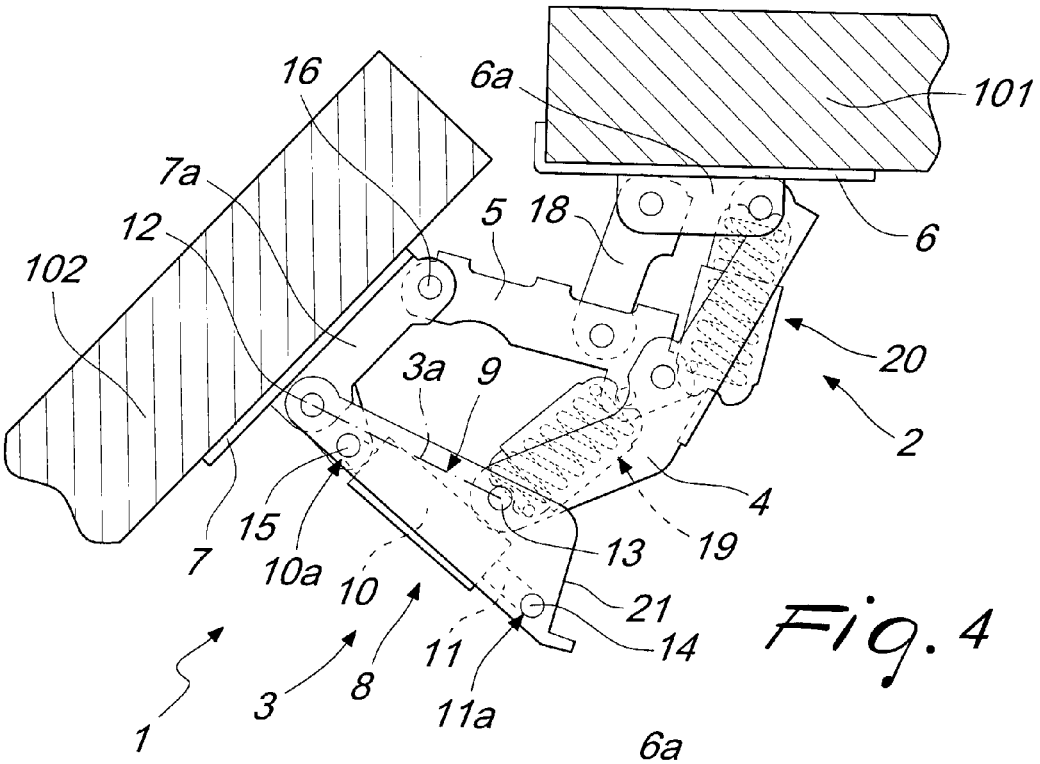

In first and second intermediate configurations, shown respectively in FIGS. 3 and 4, the two plates 6 and 7 move progressively closer to each other by virtue of the two quadrilaterals 2 and 3. In these intermediate configurations, the stem 11 protrudes slightly from the main body 10 and begins to pass from the compression position to the extension step. However, this protrusion is still negligible, so much that it does not activate the braking means of the damping element 8 and allows movements of the hinge that are not slowed. Moreover, in these intermediate positions the second fulcrum 15 is arranged externally with respect to the quadrilateral 3, although in the second intermediate configuration it is closer to the side 3*a*.

In the transition between the second intermediate configuration and the closed configuration, the second quadrilateral 3 varies its internal angles, making the second fulcrum 15 pass from the outside to its inside, increasing considerably the distance between the second fulcrum 15 and the first fulcrum 14. This increase makes the stem 11 extend considerably from the main body 10, activating the braking means, which accordingly move the elements 8 in a damped manner into the final extension position. This last damped transition prevents the element 102 that is closing onto the element 101 from colliding violently against the latter. Conversely, for transition from the closed configuration to the open configuration, it is sufficient to apply adequate force to the element 102, enough to overcome the contrasting force of the elastic means 19 and 20, such as for example an upward force for the rotation of the door about a horizontal hinge axis for opening the respective cabinet. During the opening step, the damping element 8 merely passes from the extension position to the compression position without activating the braking means and accordingly without slowing the final step of the opening of the element 102.

Conveniently, the passage opening 17 allows partial crossing of the first arm 9 by the main body 10. Said window makes it possible to reduce the space occupation of the hinge 1. Different shapes of the first arm 9 might in fact increase its space occupation and consequently limit the closure angle of said hinge, since a protrusion thereof that shelters the damping element 8 might collide with the coupling plate 6 or with the element 102, preventing the suitable closure of the latter on the element 101.

In practice it has been found that the snap hinge with damped closure according to the present invention achieves the intended aim and objects, since it allows the damped closure of a closure element on a structure of a piece of furniture or the like without limiting in any way access to the interior of said piece of furniture, since the damping element is arranged inside the hinge itself.

Another advantage of the hinge according to the invention resides in that it allows easy installation on the closure element on the respective piece of furniture without requiring any additional work step, containing production costs. The damped hinge in fact requires no additional step of assembly, since the damping element is present directly on the hinge itself.

A further advantage of the hinge according to the invention resides in that it can be installed easily by automatic numeric control machines without requiring programming of dedicated assembly steps, since the fixing and coupling plates, as well as the distances between them, are identical to those in normal closure hinges.

Furthermore, it is possible to provide two or more damping elements arranged in series or in parallel to each other and mainly operating between two fulcrums, a first one being associated with a coupling plate that is integral with a door or with a cabinet and a second one associated with an arm of the articulated quadrilateral that comprises the coupling plate.

In addition, damping elements can be provided for slowed transition both in compression and in extension, slowing both the final closure step and the opening step of the door.

The snap hinge with damped closure thus conceived is susceptible of numerous modifications and variations, all of which are within the scope of the accompanying claims.

All the details may furthermore be replaced with other technically equivalent elements.

In practice, the materials used, as long as they are compatible with the specific use, as well as the contingent shapes and dimensions, may be any according to the requirements and the state of the art.

The invention claimed is:

1. A snap hinge with damped closure, comprising:

a first articulated quadrilateral and a second articulated quadrilateral each defined by pivot points and which share a first lever and a second lever;

a coupling plate connected to a first element and the first articulated quadrilateral;

a fixing plate connected to a second element and the second articulated quadrilateral, the hinge being movable alternately between an open configuration and a closed configuration, wherein the plates have different arrangements with respect to each other, at least one damping element that is interposed between the second quadrilateral and the fixing plate or between the first quadrilateral and the coupling plate for damped transition from the open configuration to the closed configuration or vice versa, wherein the second articulated quadrilateral comprises a first arm that is articulated to the fixing plate and to an end of the first lever, the at least one damping element being interposed between the fixing plate and the first arm, wherein the at least one damping element comprises a main body in which a stem is slidable axially, the main body having a first end rotatable with the fixing plate and the stem having a second end movable with respect to the first end and is rotatable with the first arm, the at least one damping element movable alternately between a compression position, in which the first and second ends are mutually closer and the hinge is in the open configuration, and an extension position, in which the first and second ends are mutually spaced and the hinge is in the closed configuration, wherein the first arm comprises a first pivot point that is hinged to the fixing plate, a second pivot point that is hinged to one end of the first lever and a first fulcrum that is hinged to the second end, the first pivot and the second pivot delimiting one side of the second quadrilateral and the first fulcrum being arranged outside the second quadrilateral.

2. The hinge according to claim 1, wherein the damping element is interposed between the first quadrilateral and the coupling plate for damped transition from the open configuration to the closed configuration.

3. The hinge according to claim 1, wherein the at least one damping element comprises braking means for slowed transition from the compression position to the extension position.

4. The hinge according to claim 1, wherein the fixing plate comprises a second fulcrum that is hinged to the first end, the second fulcrum being spaced further from the fixing plate with respect to the first pivot.

5. The hinge according to claim 1, further comprising a passage opening defined in the first arm for the movement of the damping element from the extension position to the compression position.

6. The hinge according to claim 1, further comprising at least first elastic means which are interposed between the first lever and the second lever.

7. The hinge according to claim 6, further comprising at least second elastic means which are interposed between the first lever and the coupling plate.

8. A snap hinge with damped closure, comprising:

a first articulated quadrilateral and a second articulated quadrilateral each defined by pivot points and which share a first lever and a second lever;

a coupling plate connected to a first element and the first articulated quadrilateral;

a fixing plate connected to a second element and the second articulated quadrilateral, the hinge being movable alternately between an open configuration and a closed configuration, wherein the plates have different arrangements with respect to each other wherein in the open configuration the plates are substantially parallel and in the closed configuration, wherein the plates are substantially perpendicular; and at least one damping element that is interposed between the second quadrilateral and the fixing plate for damped transition from the open configuration to the closed configuration or vice versa, wherein the second articulated quadrilateral comprises a first arm that is articulated to the fixing plate and to an end of the first lever, the at least one damping element being interposed between the fixing plate and the first arm, wherein the at least one damping element comprises a main body in which a stem is slidable axially, the main body having a first end rotatable with the fixing plate and the stem having a second end movable with respect to the first end and is rotatable with the first arm, the at least one damping element movable alternately between a compression position, in which the first and second ends are mutually closer and the hinge is in the open configuration, and an extension position, in which the first and second ends are mutually spaced and the hinge is in the closed configuration, wherein the fixing plate comprises a second fulcrum that is hinged to the first end, the second fulcrum being spaced further from the fixing plate with respect to the first pivot for its arrangement inside the second quadrilateral when the hinge is in the closed configuration and outside the second quadrilateral when the hinge is in the open configuration.

9. The hinge according to claim 8 wherein the first arm comprises a first pivot point that is hinged to the fixing plate, a second pivot point that is hinged to one end of the first lever and a first fulcrum that is hinged to the second end, the first pivot point and the second pivot point delimiting one side of the second quadrilateral and the first fulcrum being arranged outside the second quadrilateral.

10. The hinge according to claim 8, wherein the at least one damping element comprises braking means for slowed transition from the compression position to the extension position.

11. The hinge according to claim 8, further comprising at least one elastic means which are interposed between at least one of the first lever and the second lever or the first lever and the coupling plate.

12. A snap hinge with damped closure, comprising:

a first articulated quadrilateral and a second articulated quadrilateral each defined by pivot points and which share a first lever and a second lever a coupling plate for being connected to a first element and the first articulated quadrilateral;

a fixing plate for being connected to a second element and the second articulated quadrilateral, the hinge being movable alternately between an open configuration and a closed configuration, wherein in the open configuration the plates are substantially parallel and in the closed configuration, wherein the plates are substantially perpendicular; and at least one damping element interposed at least between the first quadrilateral and the coupling plate and between the second quadrilateral and the fixing plate for damped transition from the open configuration to the closed configuration or vice versa, wherein the at least one damping element comprises a cylinder and a stem that slides axially within the cylinder, the cylinder defining a first end and the stem defining a second end, the at least one damping element movable alternately between a compression position, in which the first and second ends are mutually closer when the hinge is in the open configuration, and an extension position, in which the first and second ends are mutually spaced when the hinge is in the closed configuration.

13. The hinge according to claim 12, wherein the second quadrilateral comprises a first arm that is articulated to the fixing plate and to the first lever, the at least one damping element being interposed between the fixing plate and the first arm.

14. The hinge according to claim 13, wherein the first arm comprises a first pivot point that is hinged to the fixing plate, a second pivot point that is hinged to one end of the first lever and a first fulcrum that is hinged to the second end of the damping element, the first pivot point and the second pivot point delimiting one side of the second quadrilateral and the first fulcrum arranged outside the second quadrilateral.

15. The hinge according to claim 13, wherein the fixing plate comprises a second fulcrum that is hinged to the first end of the damping element, the second fulcrum being spaced further from the fixing plate with respect to a first pivot point for its arrangement inside the second quadrilateral when the hinge is in the closed configuration and outside the second quadrilateral when the hinge is in the open configuration.

16. The hinge according to claim 12, further comprising at least one spring interposed between the first lever and the second lever or between the first lever and the coupling plate.

17. The hinge according to claim 12, further comprising two springs, a first spring interposed between the first lever and the coupling plate and a second spring interposed between the first lever and the second lever.

* * * * *